US006089296A

United States Patent [19]

Hess et al.

[11] Patent Number: 6,089,296

[45] Date of Patent: Jul. 18, 2000

[54] PRE-CONDITIONING OF A MEDIUM WEB DURING THE FABRICATION OF CORRUGATED PAPERBOARD

[75] Inventors: David W. Hess; Matthew M. Doeppers, both of Madison, Wis.

[73] Assignee: Marquip, Inc., Phillips, Wis.

[21] Appl. No.: 09/088,229

[22] Filed: Jun. 1, 1998

[51] Int. Cl.[7] ..... B31F 1/36

[52] U.S. Cl. ..... 156/462; 156/472; 156/497

[58] Field of Search ..... 156/205, 210, 156/322, 462, 472, 497, 499; 264/286; 425/336

[56] References Cited

U.S. PATENT DOCUMENTS

| | | | |
|---|---|---|---|
| 2,686,555 | 8/1954 | Howard | 154/31 |
| 3,347,732 | 10/1967 | Stewart | 156/497 |
| 4,140,564 | 2/1979 | Schrader | 156/205 |
| 4,889,580 | 12/1989 | Seki et al. | 156/382 |
| 5,578,160 | 11/1996 | Krznarich et al. | 156/462 |

*Primary Examiner*—Michael W. Ball
*Assistant Examiner*—Gladys Piazza
*Attorney, Agent, or Firm*—Andrus, Sceales, Starke & Sawall

[57] ABSTRACT

An apparatus for preconditioning a medium web on a corragator before fluting the medium web during the manufacturing process of corrugated paperboard uses steam flows and pressures to press the medium web against a hot plate assembly. A plurality of elongated steam showers are located within a steam chamber secured to the preconditioning apparatus. The steam chamber wall structure includes a sealed web inlet and sealed web outlet for the medium web. The velocity and pressure (e.g., average steam pressure within steam chamber approximately 0.1 to 0.3 psi) of steam injected into the steam chamber holds the medium web against hot plates to promote heat transfer from the hot plates to the medium web. In addition, the medium web is heated directly by the latent heat of steam condensation, and also moistened directly by the condensation of the steam. A vacuum may or may not be used to increase the pressure of the medium web against the hot plates.

12 Claims, 3 Drawing Sheets

PRE-CONDITIONING OF A MEDIUM WEB DURING THE FABRICATION OF CORRUGATED PAPERBOARD

FIELD OF THE INVENTION

The invention relates to the fabrication of corrugated paperboard. In particular, the invention pertains to the pre-conditioning of a medium web before the medium web is fluted during the corrugated paperboard manufacturing process.

BACKGROUND OF THE INVENTION

In the manufacturing of corrugated paperboard, a single facer apparatus is used to corrugate or flute the medium web, to apply glue to the flute tips on one face of the fluted medium web, to bring a liner web into contact with the glued flute tips on the medium web, and apply heat downstream with the liner web in contact with the glued flute tips on the medium web to provide an initial bond. The medium web is fed between inter-engaging corrugating rolls to corrugate the medium web. It is important, especially at high machine speeds, that the temperature and moisture content of the medium web prior to corrugation be sufficient to enhance the pliability of the web during the corrugating process. If the medium web is too brittle, the inter-engaging corrugating rolls are more likely to rip or burst the medium web, especially as machine speeds are increased. It is generally realized in the art that the optimum condition for the medium web prior to corrugation is approximately 212° F., and 10% moisture by weight, however these conditions can vary with the application. It is therefor relatively common in the art to preheat the medium web and/or moisten the web with steam showers before corrugating the medium web.

In the art, it is common to feed the medium web around a pre-heated drum before corrugating. The tension of the medium web holds the drum. The wrap around the drum is adjusted to promote heat transfer as desired. In a prior system developed by the assignee of this application, the pre-heated drum is replaced by a hot plate assembly in which a vacuum is used to draw the medium web against the heated surface of the hot plates. More specifically, the hot plate assembly includes a plurality of hot plate tubes defining a generally planar heat transfer contact area against which the medium web is drawn against by the vacuum. Steam is passed through each of the tubular hot plates to heat the hot plates, preferably to approximately 375° F. Using the vacuum hot plate assembly is much simpler than using a pre-heated rotating drum. While the vacuum hot plate assembly has been generally effective for pre-heating the medium web, in some applications the vacuum hot plate assembly removes more moisture from the medium web than is desirable before corrugating. This is also true with other preheaters. It is therefore desirable to modify the hot plate assembly so that the vacuum does not remove too much moisture. Also, at high production speeds, it is sometimes difficult to achieve sufficient heat transfer to the medium web to optimally pre-condition the web.

SUMMARY OF THE INVENTION

The invention is a preconditioning hot plate apparatus in which the medium web is easily preconditioned to the optimal web temperature (e.g. approximately 212° F.) and moisture content (e.g. approximately 8–10% moisture by weight), even at elevated production speeds. The invention preferably uses steam flow and pressure to maintain the medium web against the heat transfer contact area on the hot plates. More specifically, a steam chamber wall structure is provided on the hot plate assembly. The steam chamber wall structure includes a web inlet for the medium web to pass into the steam chamber and a web outlet for the web to exit the steam chamber. Preferably the web inlet and outlet are sealed to prevent substantial steam flow therethrough. Steam is injected into the steam chamber, and the velocity and pressure within the steam chamber (e.g., average pressure is about 0.1 to 0.3 psi) maintain the medium web against the heat transfer contact area on the hot plate assembly. Steam is preferably injected using a plurality of elongated steam showers disposed transversely across the hot plate assembly.

This configuration is an especially efficient manner for transferring the appropriate amount of heat and moisture to precondition the medium web even at relatively high corrugator machine speeds. First, the pressure of the steam pushing the medium web against the heat transfer contact areas on the hot plate assembly promotes heat transfer from the heat plates to the medium web. Second, the latent heat of the steam is transferred directly to the medium web upon condensation of the steam. Third, the transfer of heat via the condensation of the steam helps to control the temperature of the medium web to approximately the optimal temperature of 212° F. Fourth, the condensing steam provides moisture to the medium web. The moisture content of the steam can be selected to accommodate moisture requirements for the medium web. As machine speed increases, it may be desirable to increase steam pressure within the steam chamber to increase heat transfer. If machine speeds are such that additional heat transfer to the medium web is desired, a vacuum can also be provided to increase the pressure of the medium web against the heat transfer contact area.

It should be apparent to those skilled in the art that an apparatus configured in accordance with the invention is especially effective for softening the medium web and rendering the medium web sufficiently pliable to form flutes in the corrugating nip even at high machine speeds. Other features and advantages of the invention should be apparent to those skilled in the art upon inspecting the drawings and the following description thereof.

DETAILED DESCRIPTION OF THE DRAWINGS

Figure 1:
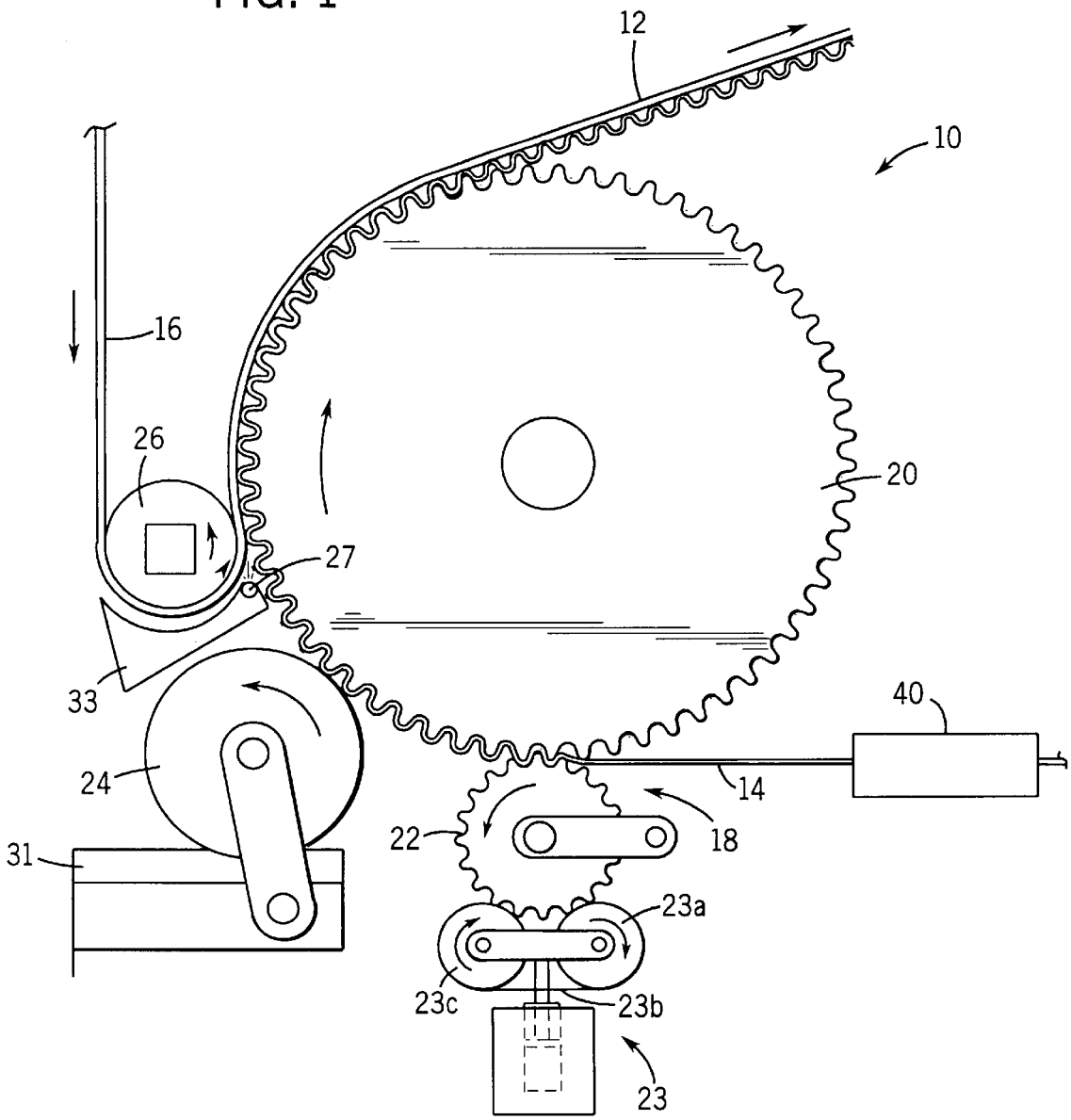
FIG. 1 is a side elevational view of a corrugator single facer having a hot plate steam assembly for preconditioning the medium web prior to corrugation.

Referring to FIG. 1, a single facer 10 operates to form a composite single face web 12 from a medium web 14 and liner web 16. The incoming medium web 14 is directed into a corrugating nip 18 defined by inter-engaging flutes on the circumference of a bonding roll 20 and on the circumference of a corrugating roll 22. The medium web 14 is deformed in the corrugating nip 18 to provide the characteristic flutes of the medium web 14. A detailed description of the inter-engaging flutes on the circumference of the bonding roll 20 and on the circumference of the corrugating roll 22 is disclosed in co-pending U.S. patent application Ser. No. 09/044,516, now U.S. Pat. No. 6,012,501 by Carl R. Marschke, filed on Mar. 19, 1998 and entitled "Single Facer With Small Intermediate Corrugating Roll and Variable Wrap Arm Device"; and, co-pending U.S. patent application Ser. No. 08/854,953, now U.S. Pat. No. 5,951,816 filed on May 13, 1997, by Carl R. Marschke, entitled "Improved Single Facer With Small Intermediate Corrugating Roll", both incorporated herein by reference. Briefly, the corrugating roll 22 is relatively small compared to the bonding roll 20. Deflection of the corrugating roll 22 is preferably controlled by a plurality of belted backing roll arrangements 23. Each arrangement 23 includes a pressure belt 23*b* around idler rollers 23*i* which are pneumatically mounted to the single facer structure. The belt 23*b* may be fluted to match the fluted surface of the small corrugating roll 22. The arrangements 23 supply a backing force along the entire axial length of the small diameter corrugating roll 22. Since each of the backing roll arrangements 23 includes its own pneumatic cylinder, each backing roll arrangement can be configured to operate independently such that the backing force is varied along the axial length of the small diameter corrugating roll 22.

The inter-engaging flutes on the circumference of the bonding roll 20 and on the circumference of the corrugating roll 22 are both of the same size, shape and pitch. In accordance with standards in the corrugated paperboard industry, flute configurations vary in terms of pitch dimension (number of flutes per foot) and flute depth (crown to root dimensions). In the United States, the configurations range from A-flute having 33–35 flutes per foot and a flute depth of 0.185 inches to E-flute having 90–96 flutes per foot and a flute depth of 0.045 inches. The pitch of an A-flute is approximately one-third of an inch, whereas the pitch of an E-flute is approximately one-eighth of an inch.

The corrugating nip 18 between the fluted surfaces of the inter-engaging rolls 20, 22 can provide substantial stress on the medium web 14, especially as machine speed increases.

Downstream of the corrugating nip 18, the fluted medium web 14 wraps around the corrugated surface of the bonding roll 20. As the bonding roll 20 carries the fluted medium 14 around its circumference, the flute tips of the corrugated medium web 14 are contacted by a rotating glue application roll 24. The glue application roll 24 applies a layer of aqueous starch-based adhesive to the flute tips on the medium web 14 to create continuous glue lines along the flute tips. The aqueous starch based adhesive is preferably stored in a glue pan 31 prior to being applied to the flute tips by the rotating glue application roller 24. Just after the glue application roll 24, the liner web 16 is brought tangentially into contact with the glued flute tips of the corrugated medium roll 14. Prior to the convergence of the webs 16, 14, the liner web 16 is wrapped around the circumference of a liner roller 26. In some applications, it may be desirable to preheat the liner web 16 to a temperature sufficiently higher than the gelatinization temperature of the adhesive (i.e., above about 150° F.), preferably to about 180° to 212° F. Preferably, preheating plates are used upstream of the liner roll 26. As will be appreciated by those skilled in the art, any method of conventional pre-heating, whether by roll, hot air, steam shower, radiant energy, or other known source, may be employed in pre-heating the liner web 16, or it may be found that pre-heating is not required in particular applications.

Preferably, the liner roll 26 is spaced from the fluted outer surface of the bonding roll 20 by a distance sufficient to preclude any significant nip pressure on the joined webs 14, 16. At the convergence of the webs 14, 16, the liner roll 26 is preferably spaced by a distance at least as great as the combined thickness of the webs 14, 16. Thus, there should be no stress applied to either the liner web 16 or the corrugated medium web 14, and the chance of tearing either of the two webs at this point in the process is greatly reduced. In addition, the glue line at the flute tips on the medium web 14 are not squeezed to displace moisture prematurely from the adhesive.

A steam shower 27, and preferably a dry steam shower 27, as disclosed in co-pending patent application Ser. No. 09/088,215 entitled "High Speed Corrugator Single Facer With Steam Injection" by David W. Hess, et al, assigned to the assignee of the present application, and filed on even date herewith, injects steam along the line of convergence between the webs 14, 16 to facilitate proper adhesive gelatinization. The steam shower 27 is mounted on a mounting bracket 33 that is preferably constructed integrally with a water cooled glue shield as is shown in FIG. 1.

After the liner web 16 is initially introduced to the fluted medium web 14 on the bonding roll 20, the composite webs 14, 16 are subsequently carried on the bonding roll 20 together until the composite single face web 12 is transferred from the bonding roll 20 for further processing downstream in the corrugator. The bonding roll 20 is preferably heated to approximately 375° F. to promote dehydration of the adhesive and formation of a green bond having sufficient strength to withstand further processing downstream in the corrugator. If desired, a variable wrap arm device such as disclosed in co-pending U.S. patent application Ser. No. 09/044,516, filed on Mar. 19,1998, by Carl R. Marschke, entitled "Single Facer With Small Intermediate Corrugating Roll and Variable Wrap Arm Device" incorporated herein by reference, may be used to lengthen the time in which the composite webs 14, 16 are in contact with the bonding roll 20 subsequent to convergence of the webs on the bonding roll 20.

In accordance with the primary aspect of the invention, a hot plate precondition apparatus 40 is disposed upstream of the single facer 10 to precondition the medium web 14 prior to corrugation of the web 14. As mentioned, the purpose of the preconditioning apparatus 40 is to soften the medium web 14 and render the web 14 sufficiently pliable for effective corrugation even at high machine speeds. Although the optimum temperature and moisture content for the medium web prior to corrugation may vary depending on the application, it is generally recognized that a moisture content of 8–10% and a temperature of approximately 212° F. will be optimum under most operating conditions.

Figure 2:
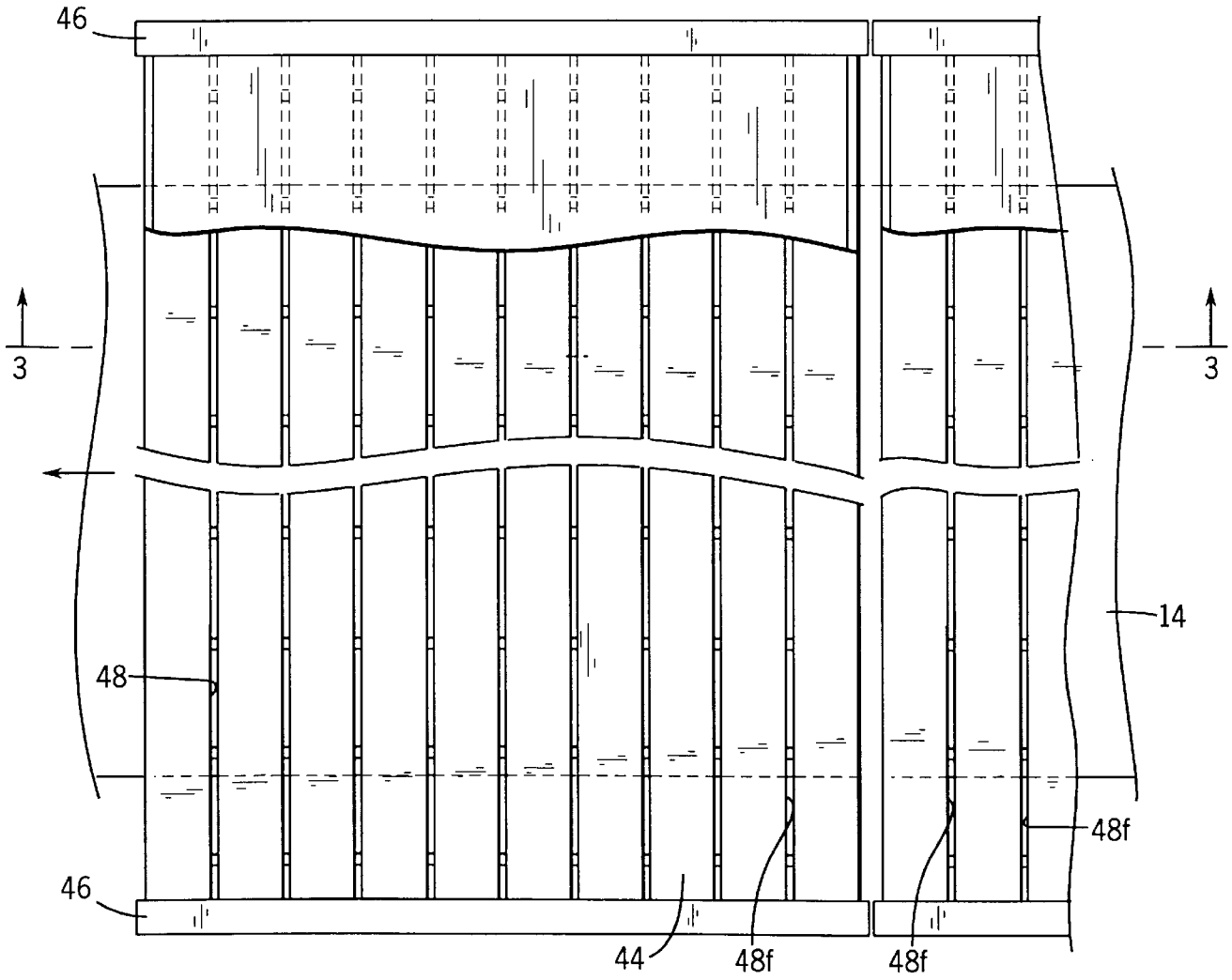
FIG. 2 is a top view schematically illustrating a hot plate assembly in accordance with the invention.
Figure 3:
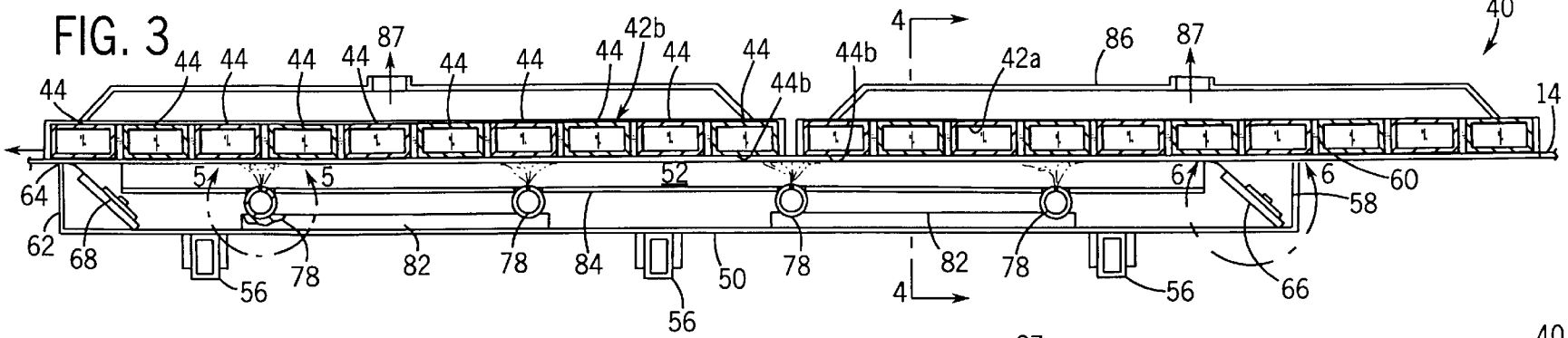
FIG. 3 is a sectional view of the hot plate assembly along the machine direction as taken along line 3—3 in FIG. 2.
Figure 4:
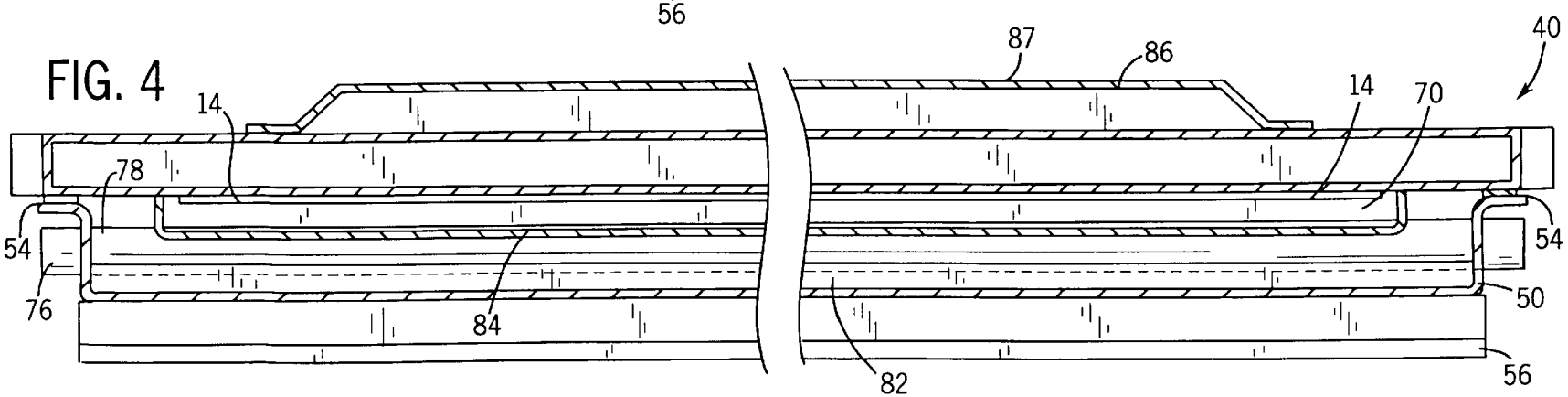
FIG. 4 is a sectional view of the hot plate assembly along the direction transverse to the machine direction taken along line 4—4 in FIG. 3.

Referring now to FIGS. 2–4, the preconditioning apparatus 40 includes two hot plate assemblies 42*a*, 42*b*. Each hot plate assembly 42*a*, 42*b* preferably consist of a plurality of elongated rectangular tubes 44. Steam flows through the rectangular tubes 44 to heat the tubes 44. Steam headers 46 are provided for flowing steam to and from the rectangular tubes 44. Gaps 48 are provided between the rectangular tubes 44. As shown in FIGS. 3 and 4, the medium web 14 passes through the apparatus 40 in contact with the hot plate assemblies 42*a*, 42*b*. In particular, the bottom heated surfaces 44*b* of the rectangular tubes 44 define a heat transfer contact area that is generally planar, and substantially co-planar with the plane of the medium web 14 passing through the apparatus 40. Preferably, steam is passed through the rectangular tubes 44 such that the bottom surfaces 44*b* are heated to approximately 375° F.

A steam chamber wall structure 50 extends along the hot plate assemblies 42*b*, 42*a* to provide a steam chamber 52 adjacent the heat transfer contact area 44*b*. High temperature silicon seals 54, FIG. 4, are provided to seal the structure 50 against the hot plate assemblies 42*a*, 42*b*. Cross supports 56 secure the steam chamber wall structure 50 in position with respect to the hot plate assemblies 42*b*, 42*a*. The steam chamber wall structure 50 includes a front wall 58, FIG. 3, that contains a web inlet 60 through which the medium web 14 enters the steam chamber 52. The steam chamber wall structure 50 also includes a rear wall 62 that contains a web outlet 64 through which the medium web 14 exits the steam chamber 52.

Figure 6:
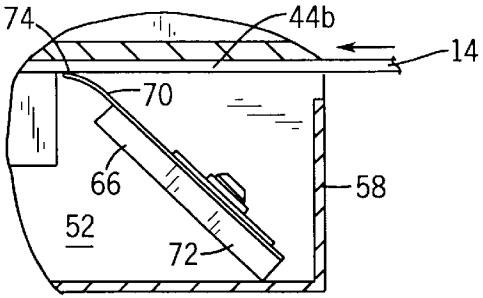
FIG. 6 is a detailed view of the area surrounded by line 6—6 in FIG. 3 of a web inlet seal for a steam chamber used in accordance with the preferred embodiment of the invention.

As shown in FIGS. 3 and 6, it is preferred that the apparatus 40 include an inlet steam seal 66 for the web inlet 60 of the steam chamber wall structure 50, as well as an outlet steam seal 68 for the web outlet 64 of the steam chamber wall structure 50. Preferably, the configuration of the inlet steam seal 66 and the outlet steam seal 68 are similar. The purpose of the inlet steam seal 66 is to allow the passage of the medium web 14 into the steam chamber 52, and seal the web inlet 60 to substantially prevent steam from escaping from the steam chamber 52 through the web inlet 60. The purpose of the outlet steam seal 68 is to allow passage of the medium web 14 from the steam chamber 52 and seal the web outlet 64 to prevent a substantial amount of steam from escaping the steam chamber 52 through the web outlet 64. The preferred configuration for the inlet steam seal 66 is shown in detail in FIG. 6. Preferably, the seal 66 comprises a flexible thin wall 70, such as spring steel having a thickness in the range of 0.005 inches to 0.015 inches affixed to a base member 72. The free end 74 of the flexible thin wall is disposed to press against the medium web 14 as the medium web enters the steam chamber 52. Preferably, the resilient thin wall member 70 provides 0.25 psi pressure against the web 14. The thin wall 70 should have sufficient flexibility and resilience to maintain contact with the medium web over the typical range of operating speeds and conditions for the corrugator. Note that it is not necessary that the resilient thin wall 70 of the seal 66 span entirely across the steam chamber 52, see FIG. 4, as long as it extends essentially along the length of the web inlet 60.

Figure 5:
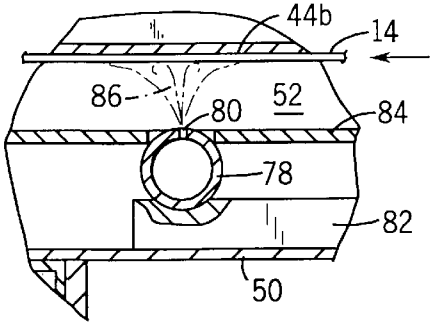
FIG. 5 is a detailed view of the region surrounded by line 5—5 in FIG. 3 showing steam injection in accordance with the present invention.

A flow of steam is provided into the steam chamber 52 through a high pressure steam inlet 76. From the steam inlet 76, the steam is routed to a plurality of steam showers 78 mounted within the steam chamber 52. Each of the steam showers 78 consist of an elongated tube 78 that spans transversely across the steam chamber 52, see FIG. 4. Each steam shower tube 78 includes a plurality of aligned steam discharge holes 80, FIG. 5. The steam shower tubes 78 are mounted on the floor of the steam chamber wall structure 50 using mounting plates 82. The steam showers 78 inject steam into the steam chamber 52 through elongated slots in an internal baffle plate 84. As shown in FIG. 5, the steam 86 is injected directly on the medium web 14, although indirect steam injection may be used in accordance with the invention. The aligned steam discharge holes 80 have a small diameter (for example, 0.015 to 0.063 diameter) and preferably span evenly across the length of the shower 78.

Steam flows from the steam chamber 52 primarily through the portion of the gaps 48*f* (FIG. 2) between the rectangular steam tubes 44 which the medium web 14 does not cover. The steam 86 flowing into the steam chamber 52 provides pressure and velocity against the lower side of the medium web 14 to maintain the upper side of the medium web 14 against the heat transfer contact area 44*b* on the hot plate assembly 42*a*, 42*b* as the medium web 14 passes through the apparatus 40. Typically, the steam flow into the apparatus 40 through the inlet 76 should be controlled to maintain an average steam pressure of about 0.1 to 0.3 psi within the steam chamber 52. Higher steam flows and pressure (about 0.25 to 0.3 psi) may be required as machine speed increases to increase heat transfer to the web 14. Substantially higher average steam pressure in the steam chamber 52 will cause excessive drag on the web 14.

If desired, the apparatus 40 may also include vacuum plenums 86 for each heat plate assembly 42*b*, 44*a*. A vacuum can be applied to plenums 87 to increase the pressure of the medium web 14 against the planar heat transfer contact area 42*b* to increase heat transfer from the heated rectangular tubes 44 to the web 14. If the preconditioning apparatus 40 includes the vacuum plenums 87, but additional heat transfer by the additional vacuum force is not desired, the vacuum can be turned off.

As described thus far, a preconditioning apparatus 40 constructed in accordance with the preferred embodiment of the invention uses the velocity and pressure of steam to support the medium web 14 against the heat transfer contact area. As mentioned, the use of steam is particularly desirable in most applications because 1) the latent heat of the steam is directly transferred to the medium web 14 upon condensation, thus facilitating efficient heat transfer to the web 14, 2) heating the web 14 by steam condensation effectively controls heating of the web 14 to approximately the optimal preconditioning temperature of 212° F., and 3) the condensation of steam adds moisture to the web 14 which is normally desirable so that the web achieves an optimum moisture content in the range of 8–10% by weight. Also as previously mentioned, the amount of suspended liquid water within the injected steam 86 can be adjusted as necessary to achieve optimum web moistening.

In some cases however the use of steam may not be necessary. In these applications, the invention may be implemented using air velocity and pressure to maintain the medium web 14 against the heat transfer contact area 44*b* of the apparatus 40, either alone or in combination with a vacuum.

It should be apparent to those skilled in the art, the invention as described promotes heat transfer and moisture transfer to the medium web 14 at accelerated rates, and therefore enables optimum preconditioning of the medium web prior to corrugation at high corrugator production speeds.

While the invention has been disclosed in connection with a preferred embodiment, variations and modifications of the invention may be apparent to those skilled in the art. The following claims should be interpreted to include such variations and modifications.

We claim:

1. In a single facer, providing a preconditioning apparatus for a medium web prior to fluting the medium web for manufacturing corrugated paperboard, wherein the preconditioning apparatus comprises:

a hot plate assembly having a heat transfer contact area containing one or more heated surfaces on a bottom of the hot plate assembly;

a steam chamber wall structure extending along the bottom of the hot plate assembly to provide a steam chamber adjacent the heat transfer contact area, the steam chamber wall structure containing a web inlet through which the medium web enters the steam chamber and a web outlet through which the medium web exits the steam chamber; and a steam inlet for providing a flow of steam into the steam chamber, wherein the steam flowing into the steam chamber provides sufficient pressure and velocity against a lower side of the medium web to maintain an upper side of the medium web against the heat transfer contact area on the hot plate assembly as the medium web passes through the apparatus.

2. An apparatus as recited in claim 1 wherein the hot plate assembly comprises:

a plurality of steam heated hot plates arranged generally in parallel with one another and transverse to a machine direction in which the medium web passes through the apparatus.

3. An apparatus as recited in claim 1 wherein the heat transfer contact area on the hot plate assembly lies generally in a single plane that is substantially co-planar with a plane in which the medium web travels as the medium web passes through the apparatus.

4. An apparatus as recited in claim 1 further comprising:

an inlet steam seal for the web inlet of the steam chamber wall structure that allows the passage of the medium web into the steam chamber and seals the web inlet with the medium web passing therethrough to substantially prevent steam from escaping from the steam chamber through the inlet steam seal; and an outlet steam seal for the web outlet of the steam chamber wall structure that allows the passage of the medium web from the steam chamber and seals the web outlet with the medium web passing therethrough to prevent a substantial amount of steam from escaping from the steam chamber through the outlet steam seal.

5. An apparatus as recited in claim 4 wherein the inlet steam seal comprises a flexible thin wall having a base fixed to the steam chamber wall structure and a free end disposed to press against the medium web as the medium web enters the steam chamber, the thin wall having sufficient flexibility and resilience to maintain at least part of the free end of the inlet steam seal against the medium web over the typical range of operating speeds and conditions for the corrugator; and the outlet steam seal also comprises a thin wall having a base fixed to the steam chamber wall structure and a free end disposed to press against the medium web as the medium web exits the steam chamber, the thin wall having sufficient flexibility and resilience to maintain at least a part of the free end of the outlet steam seal against the medium web over the typical range of operating speeds and conditions for the corrugator.

6. An apparatus as recited in claim 5 wherein the thin wall for the inlet steam seal and the thin wall for the outlet steam seal each comprise a spring steel member having a thickness in a range of 0.005 inches to 0.015 inches.

7. An apparatus as recited in claim 2 wherein the hot plate assembly includes gaps between adjacent hot plates, and steam in the steam chamber exits primarily through the gaps between the adjacent hot plates not covered by the medium web.

8. An apparatus as recited in claim 1 further comprising a vacuum that helps to maintain the medium web against the heat transfer contact area on the hot plate assembly by pulling the medium web against the hot plate assembly as the medium web passes through the apparatus.

9. An apparatus as recited in claim 1 wherein the average pressure of the steam within the steam chamber is approximately 0.10 to 0.30 psi.

10. An apparatus as recited in claim 1 further comprising a variable flow steam control valve that controls the amount of steam entering the steam chamber through the steam inlet.

11. An apparatus as recited in claim 1 wherein the hot plates are maintained at approximately 375° F.

12. An apparatus as recited in claim 1 wherein the steam inlet comprises at least one steam shower that includes a plurality of steam discharge openings disposed to discharge steam into the steam chamber, said plurality of steam discharge openings being aligned transverse to a machine direction in which the medium web passes through the apparatus.

* * * * *